US005906699A

United States Patent [19]

Mombach

[11] Patent Number: 5,906,699

[45] Date of Patent: May 25, 1999

[54] METHOD OF MAKING PAPER LAMP SHADES

[75] Inventor: Dagmar Mombach, München, Germany

[73] Assignee: Ingo Maurer, Munich, Germany

[21] Appl. No.: 08/860,767

[22] PCT Filed: Dec. 8, 1995

[86] PCT No.: PCT/EP95/04847

§ 371 Date: Jun. 12, 1997

§ 102(e) Date: Jun. 12, 1997

[87] PCT Pub. No.: WO96/20078

PCT Pub. Date: Jul. 4, 1996

[30] Foreign Application Priority Data

Dec. 23, 1994 [DE] Germany ..... 44 46 473

[51] Int. Cl.[6] ..... B31F 53/06

[52] U.S. Cl. ..... 156/221; 156/226; 493/405; 362/352

[58] Field of Search ..... 493/302, 399, 493/407, 419, 292, 405, 456, 458, 462, 941, 950; 156/183, 221, 226, 227, 143, 144; 264/322, 507, DIG. 52; 362/352

[56] References Cited

U.S. PATENT DOCUMENTS

| | | | |
|---|---|---|---|
| 1,958,459 | 5/1934 | Angeletti | 93/1 |
| 2,404,162 | 7/1946 | Brown | 493/292 X |
| 2,556,521 | 6/1951 | Chase | 493/405 |
| 3,076,228 | 2/1963 | Johnson | 18/19 |
| 3,859,897 | 1/1975 | Higa | 93/84 |
| 4,562,521 | 12/1985 | Noguchi | 362/352 X |
| 5,060,565 | 10/1991 | Schonheit | 100/331 |

FOREIGN PATENT DOCUMENTS

| | | | |
|---|---|---|---|
| 0 144 526 | 6/1985 | European Pat. Off. | D06C 21/00 |
| 0 529 766 | 3/1993 | European Pat. Off. | D06J 1/12 |
| 394885 | 4/1909 | France | B31D 5/06 |
| 1307907 | 2/1963 | France | B29C 53/30 |
| 1209279 | 1/1966 | Germany | B28C 53/30 |
| 26 47 542 | 4/1978 | Germany . | |
| WO 85/03454 | 8/1985 | WIPO | B01D 27/06 |

OTHER PUBLICATIONS

Smook, G.A., Handbook of Pulp & Paper Terminology, Angus Wilde Publications, Bellingham, WA, pp. 61 and 247, 1990.

"Shibori—The Inventive Art of Japanese Shaped Resist Dying"—Pole–Wrapping Cloth Pole–Wrapped and Compressed, Jan. 1, 1983, pp. 123–138.

*Primary Examiner*—Michael W. Ball
*Assistant Examiner*—Shawn A. Mitchell
*Attorney, Agent, or Firm*—Dougherty & Associates

[57] ABSTRACT

In a method of making paper lamp shades the paper is wrapped at least around part of a circumferential surface of a cylindrical body. A thread is wrapped around the paper applied to the circumferential surface. The paper having the thread wrapped therearound is pushed together, in a direction along the cylindrical body, thereby folding the paper. Then the pushed together paper is removed from the cylindrical body.

21 Claims, 3 Drawing Sheets

METHOD OF MAKING PAPER LAMP SHADES

FIELD OF THE INVENTION

The present invention relates to a method of making paper lamp shades.

In particular, the present invention refers to a method in which the paper for forming the lamp shades is folded in such a manner that it assumes a three-dimensional structure.

BACKGROUND ART

There are various methods for folding materials known in the prior art.

EP 0 144 526 A1 discloses a method for the press treatment of fabrics. This method makes use of an apparatus having two rotating rollers rotating in opposite directions and at different speeds and being spaced from each other. The fabric to be treated is moving along the two rollers while it is guided by a limiting means disposed between the two rollers. Due to the different rotational speeds of the two rollers, a folded structure of the fabric is created, resulting in a uniform "zigzag" fold structure of the fabric.

EP 0 529 766 A1 discloses a method of pleating articles of clothing. In this method, the garment is pleated, rolled together, twisted and then clamped in a holding device. This holding device then is introduced into an apparatus for thermal treatment, and the garment is simultaneously heat-treated and pleated by means of a saturated current.

The technical publication "Shibori—The Inventive Art of Japanese Shaped Resist Dying", Kodansha Int., 1983, pages 123 to 138, discloses a method of producing dyed patterns on a fabric. In this method, the fabric is wrapped around a bar, a thread is placed around the fabric, the fabric on the bar is pushed together and finally is dyed in this pushed together condition. By way of this method, a pattern is formed on the fabric which is pulled straight again after dying, with the pattern being dependent upon the folded state of the fabric prior to application there of on the bar, the winding density of the thread and on the winding direction.

For manufacturing lamp shades of paper, it is necessary for the paper to adopt a three-dimensional structure, so that the lamp shades formed thereof retain this structure upon conclusion of the method. This means that the shape of the paper lamp shades does not alter any more after manufacture thereof.

The methods described hereinbefore deal exclusively with the folding or pleating of fabrics, and it is apparent in this respect that these methods do not create a three-dimensional structure of the fabrics as it is indispensable, for example, for lamp shades that are not fixed to a carrier grid, but are supported just by a supporting structure.

SUMMARY OF THE INVENTION

It is the object of the invention to fold a paper in such a manner that a three-dimensional structure is formed permitting the utilization of the folded paper as a lamp shade.

The present invention provides a method of making paper lamp shades, comprising the following steps:

a) wrapping the paper at least around part of a circumferential surface of a cylinder;

b) wrapping a thread around the paper applied to the circumferential surface;

c) pushing together the paper having the thread wrapped therearound, in a direction along the cylinder, where by the paper is folded; and d) removing the pushed together paper from the cylinder.

According to an advantageous development of the present invention, the method of making paper lamp shades comprises the following steps:

a) fulling the paper;

b) wrapping the paper at least once and at least around part of a circumferential surface of a cylinder;

c) wrapping a thread around the paper applied to the circumferential surface;

d) at least once pushing together and/or twisting the paper having the thread wrapped therearound, in a direction along the cylinder, thereby folding the paper;

e) watering the folded paper and treating the paper with fixatives;

f) drying the paper on the cylinder;

g) removing the thread from the cylinder;

h) removing the pushed together paper from the cylinder; and i) opening the superimposed paper layers.

The invention, and its objects and advantages, will become more apparent in the detailed description of the preferred embodiments presented below.

BRIEF DESCRIPTION OF THE DRAWINGS

Preferred embodiments of the present invention will be described in more detail hereinafter with reference to the accompanying drawings, in which.

DESCRIPTION OF PREFERRED EMBODIMENTS

Figure 1:
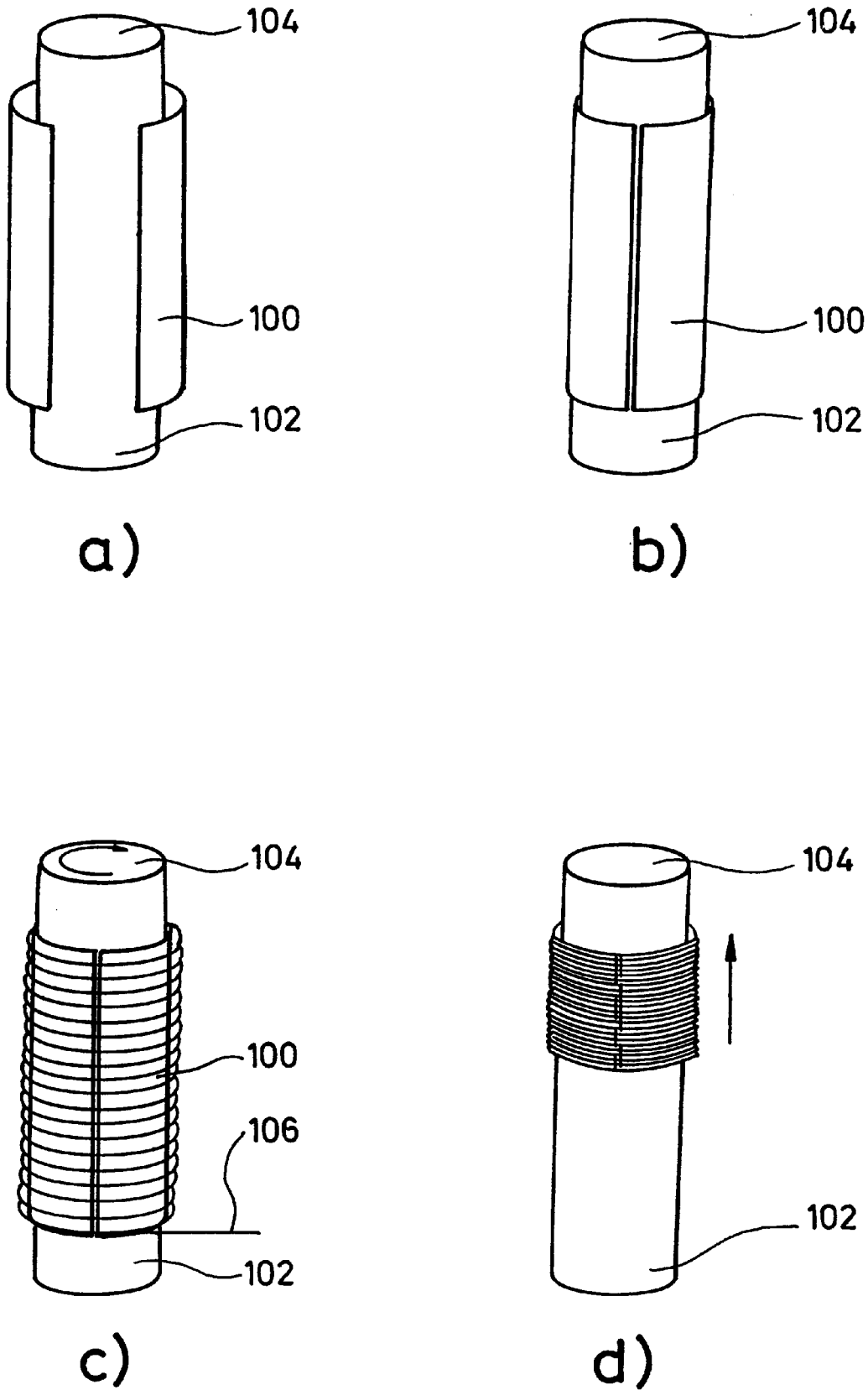
FIG. 1*a*–1*d* is a representation of the method steps according to the invention.

The method of making paper lamp shades according to the invention will now be elucidated by way of an example. The various method steps are depicted in FIG. 1.

FIGS. 1*a* and 1*b* illustrate the first method step in which a paper 100 for making the paper lamp shade is wrapped around part or around the entire circumferential surface 102 of a cylinder 104. It is apparent that the paper 100 may also be wrapped around cylinder 104 several times, if desired, so that a superimposition effect of the paper is created.

Upon application of the paper 100 on cylinder 104, the second method step, shown in FIG. 1*c*, includes wrapping of a thread 106 around the paper 100. Wrapping of the thread 106 around the paper 100 may be carried out, for example, by rotation of cylinder 104, as indicated in FIG. 1*c* by an arrow. Such rotation may be effected either by an electric motor or by hand.

The third method step, shown in FIG. 1*d*, involves pushing together of the paper 100 having the thread 106 wrapped therearound, in a direction along the cylinder 104 as indicated in FIG. 1*d* by an arrow. If desired, such pushing together may be accompanied by a twisting motion of the paper 100. This pushing together of the paper causes folding of the latter, so that the paper assumes a three-dimensional structure.

Depending on the desired three-dimensional structure, the third method step is repeated once or several times.

In the last method step, not shown in FIG. 1, the pushed together paper 100 is removed from cylinder 104.

When the paper lamp shade removed from cylinder 104 in the last step does not yet display the final shape, an additional method step is added (not shown), in which the pushed together, folded paper is pulled straight or smoothened upon removal thereof from cylinder 104, so that the desired paper lamp shade is formed.

In addition to the method steps indicated in FIG. 1, the method according to the invention may comprise further steps in accordance with a further embodiment.

Prior to the first method step, the paper 100 is fulled.

Depending on the desired shape of the lamp shade to be manufactured, the paper may additionally be folded after fulling.

After the third method step, the following steps are carried out:

The folded paper 100 is dried on cylinder 104. Depending upon the desired stiffness of the resulting lamp shade, this may take place while heat is supplied.

For further enhancing the stiffness of the lamp shade, the paper, prior to drying thereof, may be watered and treated with fixatives. Known fixatives include, e.g. steam or water glass.

After drying, thread 106 is removed so that the folded paper 100 can be removed from cylinder 104.

In accordance with the desired shape of the lamp shade, a pretreatment of the papers used may take place before beginning of the manufacture of the lamp shade. Such pretreatment, for example, includes gluing together several sheets of paper, adhering of paper bags as well as cutting into and/or punching of the papers.

It is just as possible to perform a treatment during lamp shade manufacture in which the lamp shade, for example, is dyed or gilded.

It is obvious that all of the above-described method steps for making a lamp shade or also individual method steps, in particular the second and third method steps, may also be performed several times so as to thus create a desired shape and structure of the lamp shade.

In particular when the first to fourth method steps are repeated, the new wrapping of the paper around the cylinder may take place such that the new orientation of the paper is twisted with respect to the original orientation thereof.

Figure 2:
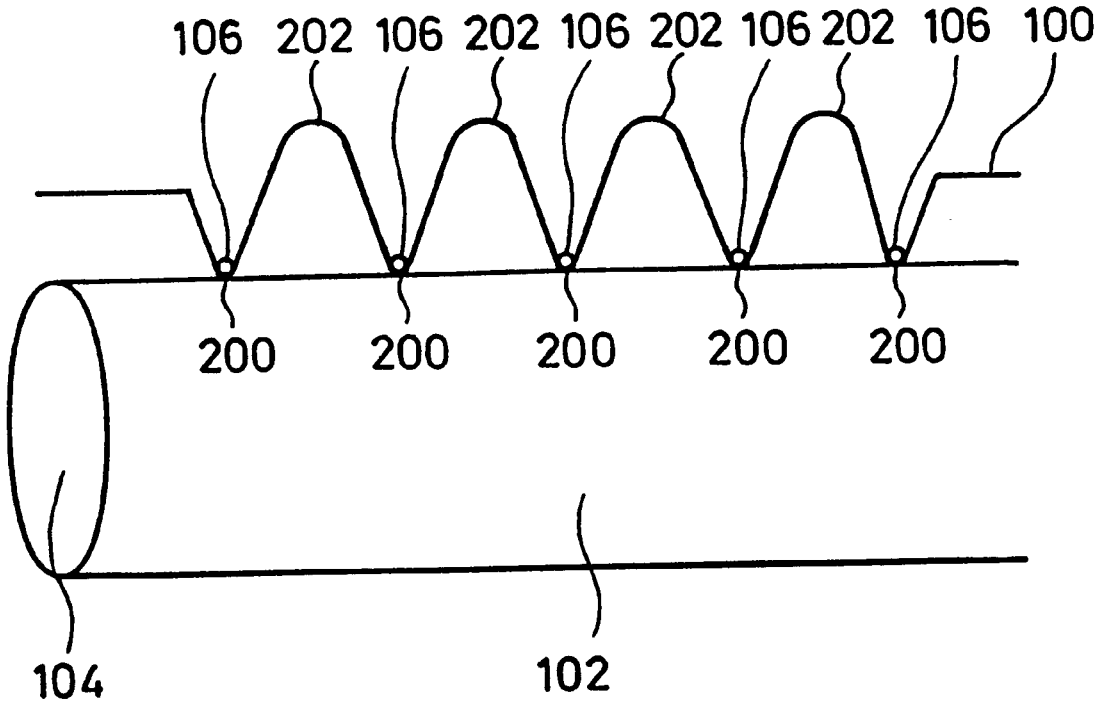
FIG. 2 is a schematic representation of the course of the fold pattern obtained by using the method according to the invention.

In the following, the particular course of the fold pattern shown in FIG. 2 will be described. As shown in FIG. 2, the fold pattern created by the method according to the invention comprises various sections. Contrary to known folding processes, in which like fold sections follow each other that are just oriented in opposite directions, the method according to the invention produces a fold pattern in which a pointed section 200 and an arcuate section 202 alternate with each other in succession. These sections 200 and 202 may have different heights and radii.

The pointed sections 200 are formed during pushing together of the paper, on the side of the paper facing circumferential surface 102, at those sections of the paper where the latter is in contact with thread 106.

The arcuate sections 202 are created during pushing together of the paper 100 on the side of the paper facing away from circumferential surface 102.

The particular course of the fold pattern, to be more precise, the distances of the pointed sections 200 from each other, is dependent upon the winding density of thread 106. This winding density is variable, so that different distances between the pointed sections 200 of the fold pattern may be created in a particular paper.

In accordance with the size of the particular lamp shade to be manufactured, various cylinders 104 of different diameters are employed, with the cylinders 104 employed being made, for example, of plastics material or metal.

It is not necessary for application of the method according to the invention that the paper 100 is present in a specific shape or thickness. This means that the paper 100 used, prior to application thereof to cylinder 104, may be cut to a specific shape and/or folded to a specific shape. The configuration of the blank and/or the folding thereof are dependent on the desired shape of the lamp shade. It is apparent that these measures permit the manufacture of paper lamp shades of more complex configurations.

Figure 3:
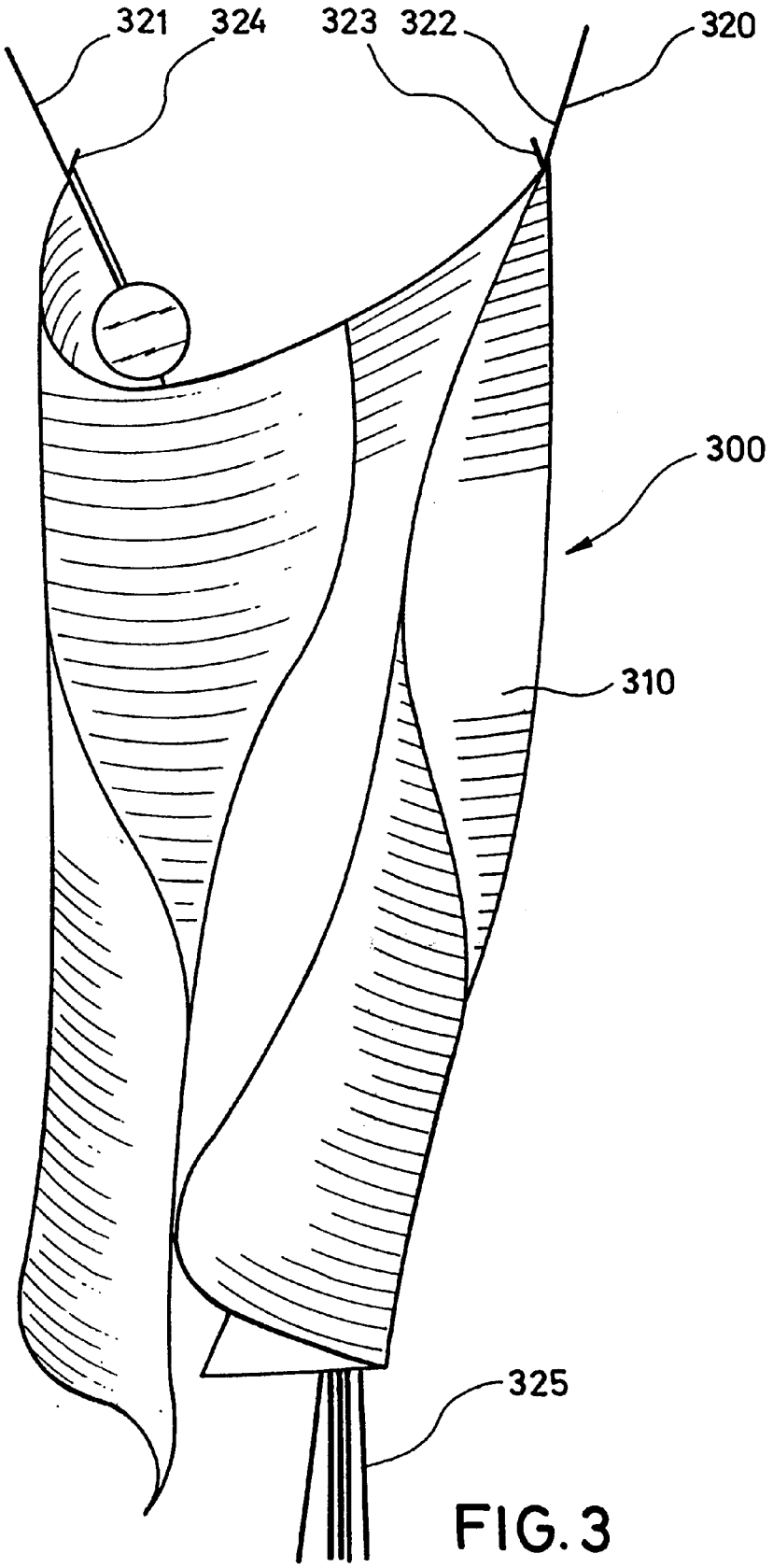
FIG. 3 shows a paper lamp shade manufactured in accordance with the method of the invention.

FIG. 3 shows a lighting fixture 300 having a lamp shade 310 made in accordance with the manufacturing method according to the invention.

Lighting fixture 300 comprises a lamp shade 310 and a supporting frame 320 including two substantially V-shaped supporting arms 321, 322 extending away from each other from a foot part 325 at an acute angle in upward direction. Close to the free ends thereof, the two supporting arms 321, 322 have holding members 323, 324 which are in engagement with corner portions of the paper lamp shade 310 so as to fix the same.

The spherical configuration of the paper lamp shade 310 made by the method according to the invention is effected by folding the paper along two mutually opposite outer edges of the resulting lamp shade.

However, it is apparent to the expert that both the shape of the still unfolded paper and the density of the folds produced, which is defined by the winding pattern, can be modified by the designer of the lamp shade within wide limits.

What is claimed is:

1. A method of making paper lamp shades, comprising the following steps:

a) wrapping paper at least around part of a circumferential surface of a cylindrical body;

b) wrapping a thread around said paper applied to said circumferential surface;

c) pushing together said paper having the thread wrapped therearound, in a direction along said cylindrical body, thereby folding said paper; and d) removing said pushed together paper from said cylindrical body to form a lamp shade.

2. A method according to claim 1, wherein prior to step a), a fulling step of said paper is carried out;

step a) includes multiple wrapping and superimposition of said paper on said cylindrical body;

step c) includes a twisting step during pushing together of said paper on said cylindrical body;

steps b) and c) are carried out several times on the same said paper;

after step c) the following steps are performed:
watering said paper on said cylindrical body;
drying said paper on said cylindrical body; and
removing said thread from said cylindrical body; and after step d), the additional step of pulling said pushed together paper straight is carried out.

3. A method according to claim 2, comprising a paper folding step subsequent to said fulling step.

4. A method according to claim 2, wherein drying of said paper takes place by addition of heat.

5. A method according to claim 2, wherein prior to the step of drying of said paper, the paper is watered and treated with fixatives.

6. A method according to claim 2, wherein prior to the step of drying of said paper, the paper is subjected to dyeing.

7. A method according to claim 2, wherein the step of pulling said pushed together paper straight includes smoothening of said paper layers.

8. A method according to claim 1, wherein steps a) to d) are carried out several times on the same said paper, wherein during new wrapping of the paper around said cylindrical body, the paper is twisted relative to its original orientation on the cylindrical body.

9. A method according to claim 1, wherein said paper is pretreated, with said pretreatment including at least one of the following steps:

a. gluing together several sheets of paper;

b. adhering paper bags to said paper;

c. cutting into said paper; and d. punching said paper.

10. A method according to claim 1, wherein the pushed together, folded paper is pulled apart after removal thereof from said cylindrical body.

11. A method according to claim 1, wherein the course of the fold pattern comprises, in alternating manner, a pointed section and an arcuate section, with the pointed section being formed in the section of said paper that faces said circumferential surface and is in contact with said thread, with said arcuate section being formed by said pushing together of said paper in the section of said paper facing away from said circumferential surface.

12. A method according to claim 1, wherein the thread is wrapped around said paper by rotation of said cylindrical body, with said rotation being effected by a motor or by hand.

13. A method according to claim 1, wherein cylindrical bodies of different diameters are used for making lamp shades having different curvatures.

14. A method according to claim 1, wherein the winding density of said thread is variable.

15. A method according to claim 1, wherein said paper, prior to application to said cylindrical body, is cut to a predetermined shape.

16. A method according to claim 1, wherein said paper, prior to application to said cylindrical body, is folded to a predetermined shape.

17. A method according to claim 5, wherein said fixatives comprise steam or water glass.

18. A method of making paper lamp shades, comprising the following steps:

a) fulling paper;

b) wrapping said paper at least once and at least around part of a circumferential surface of a cylindrical body;

c) wrapping a thread around said paper applied to said circumferential surface;

d) pushing together said paper having the thread wrapped therearound, in a direction along said cylindrical body, thereby folding said paper;

e) watering the folded paper, and treating said paper with fixatives;

f) drying said paper on said cylindrical body;

g) removing said thread from said cylindrical body;

h) removing said pushed together paper from said cylindrical body; and i) pulling said pushed together paper straight to form a lamp shade.

19. A method according to claim 18, wherein steps b) through d) are repeated several times.

20. A method according to claim 18, comprising the step of folding said paper subsequent to said fulling step.

21. A method according to claim 18, wherein said step of pulling said pushed together paper straight includes smoothening of said paper layers.

* * * * *